US005152516A

United States Patent [19]

Okayama et al.

[11] Patent Number: 5,152,516

[45] Date of Patent: Oct. 6, 1992

[54] SURFACE CLEANING DEVICE, OPTICAL DETECTION DEVICE, AND PAPER SHEET DEPOSITING/DISPENSING APPARATUS

[75] Inventors: Masao Okayama, Ryugasaki; Masataka Kawauchi, Ishioka, both of Japan

[73] Assignee: Hitachi, Ltd., Tokyo, Japan

[21] Appl. No.: 397,133

[22] Filed: Aug. 22, 1989

[30] Foreign Application Priority Data

Aug. 24, 1988 [JP] Japan ..... 63-209842

[51] Int. Cl.[5] ..... B65H 5/22

[52] U.S. Cl. ..... 271/3.1; 271/265; 15/21.1; 15/97.1; 250/223 R; 250/571; 360/128

[58] Field of Search ..... 271/3.1, 109, 258, 259, 271/265; 15/21.1, 93.1, 97.1; 250/223 R, 239, 559, 561-563, 571, 572, 573, 574; 356/338, 429, 430; 360/128

[56] References Cited

U.S. PATENT DOCUMENTS

| | | | |
|---|---|---|---|
| 3,970,394 | 7/1976 | Stanton | 250/227.11 X |
| 4,241,368 | 12/1980 | Tadokoro et al. | 360/128 |
| 4,395,127 | 7/1983 | Duvall | 250/222.1 X |
| 4,454,419 | 6/1984 | Peter, III et al. | 250/223 R X |
| 4,670,647 | 6/1987 | Hubble, III et al. | 271/259 X |
| 4,704,647 | 11/1987 | Hino | 360/128 |
| 4,782,225 | 11/1988 | Hirose et al. | 250/223 R |
| 4,801,204 | 1/1989 | Nakamura et al. | 250/574 X |
| 4,818,132 | 4/1989 | Brull et al. | 250/571 X |
| 4,854,452 | 8/1989 | Uchida et al. | 271/3.1 X |
| 4,927,132 | 5/1990 | Westover | 271/225 |

FOREIGN PATENT DOCUMENTS

| | | | |
|---|---|---|---|
| 177773 | 10/1984 | Japan | 360/128 |
| 83214 | 5/1985 | Japan | 360/128 |
| 24449 | 2/1987 | Japan . | |
| 251909 | 10/1988 | Japan | 360/128 |

*Primary Examiner*—Robert P. Olszewski
*Assistant Examiner*—Boris Milef
*Attorney, Agent, or Firm*—Antonelli, Terry, Stout & Kraus

[57] ABSTRACT

A cleaning device capable of cleaning the surface of components, the cleaning device comprising: a cleaning member for cleaning the surface of the component which needs to be prevented from contamination; an arm made of a shape memory alloy and holding the cleaning member and also storing therein a first shape which can cause the cleaning member to be positioned on the surface of the component and a second shape which can cause the cleaning member to be retracted from the surface of the component; and shape transforming arrangement provided for the arm and transforming the shape between the first shape and the second shape.

3 Claims, 6 Drawing Sheets

SURFACE CLEANING DEVICE, OPTICAL DETECTION DEVICE, AND PAPER SHEET DEPOSITING/DISPENSING APPARATUS

BACKGROUND OF THE INVENTION

1. Field of the Invention

The present invention relates to a device capable of cleaning the surface of a component such as an optical sensor of the detection device or the surface of the head of a recording/reproducing device that are necessary to be always cleaned. More particularly, the present invention relates to an optical detection device provided with the cleaning device of the type described above. Furthermore, the present invention relates to a paper sheet depositing/dispensing apparatus provided with a plurality of the optical detection devices of the type described above.

2. Description of the Prior Art

Previously, components such as an optical sensor of the detection device whose surfaces need to be protected from contamination have been manually and directly cleaned.

When the optical sensor and the like is intended to be cleaned of contaminates, the device in which the optical sensor or the like, is incorporated must be disassembled. Therefore, a problem arises in that the cleaning operator takes an excessively long time and is complicated. In particular, an automatic cash depositing/dispensing apparatus is provided with a plurality of optical sensors for the purpose of switching the conveyance passages for the bank notes, detecting the state of the conveyance of the bank notes, and detecting the number of the bank notes which have been conveyed. However, the cleaning operation is excessively long due to the construction of apparatus employing the plurality of optical sensors. In addition, the overall cleaning operations is too complicated.

A device for cleaning an objective lens of the optical head is disclosed in Japanese Patent Unexamined Publication No. 62-24449 wherein a brush, disposed at the front end of an arm, sweeps the surface of the objective lens of the optical head whenever the disk is loaded into the apparatus or is ejected from the same. Therefore, the cleaning operation is limited to only once when the disk is inserted or ejected, causing the obtainable cleaning effect to be insufficient. Furthermore, the cleaning operation cannot be conducted individually from the operation of the apparatus. Furthermore, the construction required to include a plurality of components that must be cleaned is generally very complicated. Yet another problem resides in the fact that the complicated construction results in difficulty in the handling of the apparatus.

SUMMARY OF THE INVENTION

An object of the present invention is to provide a cleaning device for automatically cleaning the surface of a component such as an optical sensor to prevent contamination thereof.

Another object of the present invention is to provide an optical detection device provided with the cleaning device of the type described above.

A further object of the present invention is to provide a paper-sheet depositing/dispensing apparatus provided with a plurality of the optical detection devices of the type described above.

According to the present invention, there is provided a cleaning device for cleaning the surface of components, with the cleaning device comprising a cleaning member for cleaning the surface of the component which needs to be prevented from contamination, an arm of a shape memory alloy for holding the cleaning member and also storing therein at least a first shape which can cause the cleaning member to be positioned on the surface of the component and a second shape which can cause the cleaning member to be retracted from the surface of the component, and shape transforming means provided for the arm for transforming the shape of the arm between the first shape and the second shape.

According to the present invention, there is provided a cleaning device for cleaning the surface of components, with the cleaning device comprising a piezoelectric vibrator holding the component whose surface needs to be prevented from contamination, and a power source for supplying power to the piezoelectric vibrator so as to vibrate the piezoelectric vibrator and sweep up contamination adhered to the surface of the component.

According to the present invention, there is provided a cleaning device for cleaning the surface of components, with the cleaning device comprising a cleaning member for cleaning the surface of the component which needs to be prevented from contamination, a resonant arm for holding the cleaning member, a piezoelectric vibrator secured to the base portion of the resonant arm and bringing the cleaning member into contact with the surface of the component when a resonance is generated and disposing the cleaning member at a position retracted from the surface of the component when no resonance is generated, and a power source for supplying power to the piezoelectric vibrator and vibrating the piezoelectric vibrator.

According to the present invention, there is provided a cleaning device for cleaning the surface of components, with the cleaning device comprising an air duct for sending air to the surface of a component which needs to be prevented from contamination, and an air source for the air duct.

The component whose surface needs to be prevented from contamination is exemplified by an optical sensor for a detection device, a heat radiating portion for a semiconductor, and a magnetic head of a magnetic recording/reproducing device.

According to the present invention, there is provided a paper sheet depositing/dispensing apparatus comprising; a conveying passage through which paper sheets are conveyed, accumulating means for accommodating, in an accommodating portion, with the paper sheets supplied from the conveying passage, separation means for separating each of the paper sheets accommodated in the accommodating portion so as to convey the paper sheets to the conveying passage, and detection means for detecting the state in which the paper sheets are conveyed to the conveying passage, wherein the detecting surface of the detection means is provided with a cleaning device for cleaning the detecting surface.

For example, the optical sensors such as the light emitting or receiving elements suffer from a problem of impossibility of conducting their predetermined actions due to the unnecessary matter adhered to the surface which forms the optical passage thereof. The unnecessary matter can be swept away by way of operating the cleaning device according to the present invention. Therefore, the designed functions for the optical sensor can be maintained, and the function designed to the overall structure of the paper sheet depositing/dispensing apparatus such as an automatic cashier can be readily maintained.

DESCRIPTION OF THE PREFERRED EMBODIMENTS

Figure 1:
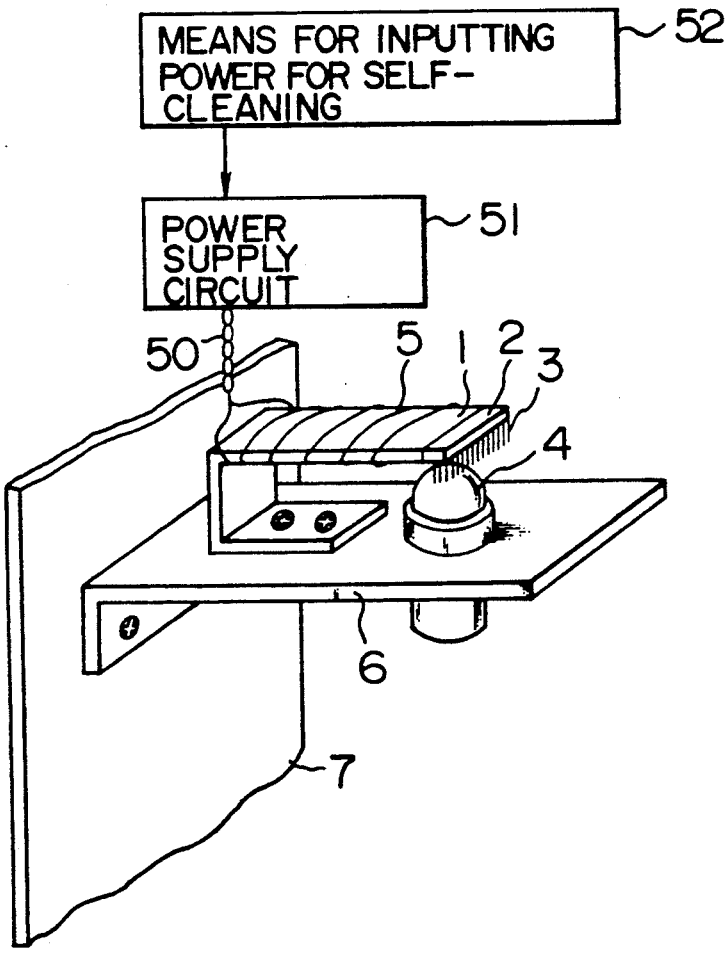
FIGS. 1 and 2 are view which illustrate an embodiment of a cleaning device according to the present invention.
Figure 2:
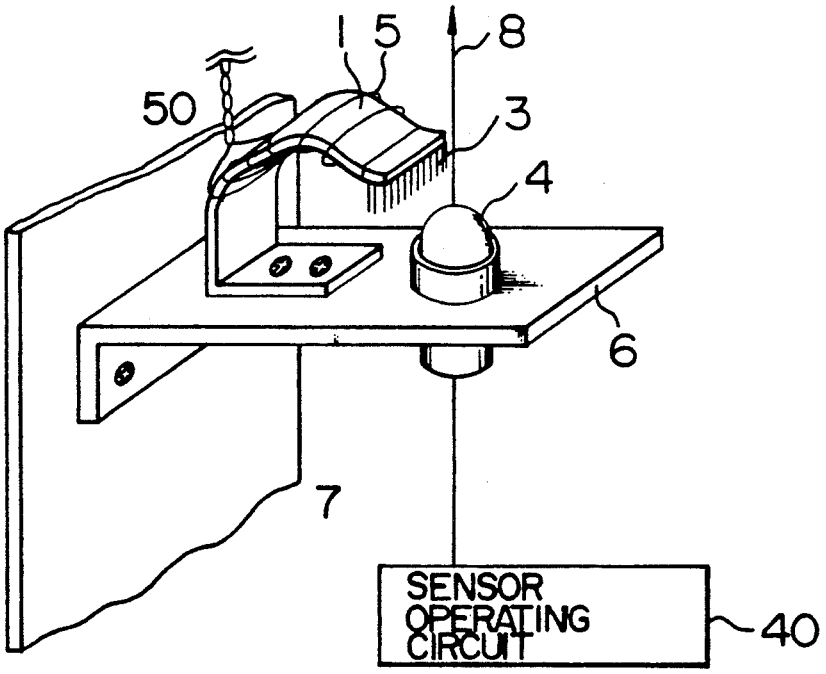

According to the embodiment of FIGS. 1 and 2, a first shape and a second shape are stored in a shape memory alloy forming an arm 1. The arm 1 has previously stored its first shape with which a cleaning component, for example, a brush 3 is, as shown in FIG. 1, able to be brought into contact with the surface of an optical sensor 4 when the temperature exceeds a transformation point. On the other hand, the arm 1 has previously stored its second shape with which the brush 3 or the arm 1 does not, as shown in FIG. 2, interrupt an optical passage 8 for the optical sensor 4 when the temperature is lower than the transformation point. This arm 1 is fastened to a sensor support frame 6 with screws at an end thereof, while a plate 2 to which the nylon brush 3 is fastened with an adhesive is secured to another end of the arm 1 with the adhesive. A coil 5 capable of serving as shape transforming means is wound around this arm 1, this coil 5 being designed such that electric power can be supplied thereto from a power supply circuit 51 via a power line 50. This power supply circuit 51 is arranged to be actuated by a demand manually issued through a self-cleaning power supply means 52.

The above-described sensor support frame 6 is secured, with screws, to a support base 7. The optical sensor 4 is actuated by a sensor actuating circuit 40 (FIG. 2) so as to conduct a light-emitting action if necessary. The shape memory alloy for the arm 1 is exemplified by Ti-Ni or Cu type shape memory alloy. However, the present invention is not so limited and, for example, a shape memory alloy of an organic type can be employed.

As a result of the structure formed as described above, the following operation can be conducted. That is, when the supply of the self-cleaning power is instructed manually through the self-cleaning power supply means 52 during the time period in which the optical sensor 4 does not act, electric power is supplied from the power supply circuit 51 to the coil 5 so that the arm 1 made of the shape memory alloy is heated up to a temperature above the transformation point. As a result, the arm 1 is, as shown in FIG. 1, transformed into the first shape which has been previously stored therein, causing the brush 3 to be brought into contact with the surface of the optical sensor 4. Thus, unwanted matter such as dust adhered to the surface of the optical sensor 4 can be physically swept away.

On the other hand, when the self-cleaning power supply is stopped, the power supply to the coil 5 is stopped so that the temperature of the arm 1 is lowered below the transformation point. As a result, the arm 1 is, as shown in FIG. 2, transformed to the second shape, causing the brush 3 or the other members to be so retracted that so as not to interrupt the optical passage 8 for the optical sensor 4.

Since the brush 3 is able to sweep away the unwanted matter adhered to the surface of the optical sensor 4 in response to the turning on of the supply of the self-cleaning power, the performance of the optical sensor 4 can be maintained intact. Therefore, the apparatuses provided with the optical sensors 4 can exhibit improved reliability and a longer service life. Furthermore, this motion for sweeping up the unwanted matter can be realized with a simple structure and in a remote control manner.

Figure 3:
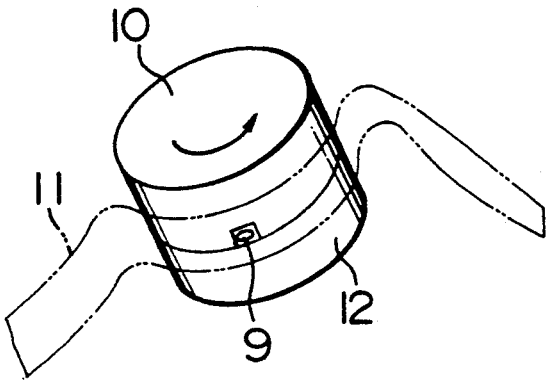
FIGS. 3 and 4 are perspective views which illustrate an embodiment in which the cleaning device according to the present invention is provided for a magnetic recording/reproducing device.
Figure 4:
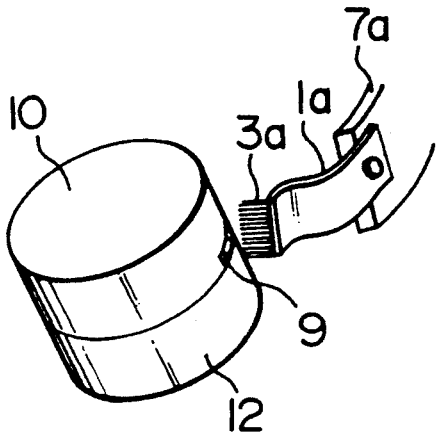

As shown in FIGS. 3 and 4, a magnetic head 9 for the magnetic recording/reproducing device is secured to a rotary cylinder 10 so as to establish a contact with a magnetic tape 11 so that recording in the magnetic tape 11 and reproducing from the same can be conducted. The magnetic tape 11 is arranged to run through the space between the non-rotary stationary cylinder 12 and the rotary cylinder 10 which form a guide body. The cleaning device comprises a brush **3*a* and an arm 1*a* securing the brush 3 and being made of a shape memory alloy for controlling the position of the brush 3*a*. An end of the arm 1*a* is secured to a support base 7*a*, and a power source (not shown) supplies power for heating the arm 1*a* for the purpose of transforming the shape of the arm 1*a***.

The brush **3*a* is so positioned that it cannot be brought into contact with the magnetic head 9 and is so positioned not to interrupt the running of the magnetic tape 11 when the heating power is not supplied. On the other hand, when the heating power is supplied, the arm 1*a* is transformed so that the brush 3*a* is moved to a position at which the same can be brought into slight contact with the surface of the magnetic head 9** during this transformation motion.

In the embodiment of FIGS. 3 and 4, if the power is supplied to the arm **1*a* when recording in the magnetic tape 11 and reproducing from the same are performed, the arm 1 is so heated as to be transformed so that the brush 3*a* is so positioned as to be brought into contact with the surface of the magnetic head 9. As a result of this action, contamination such as dust or oil adhered to the surface of the magnetic head 9 can be swept away. If necessary, the turning on and off of the power source can be repeated. Therefore, the recording/reproducing of magnetic information to and from the magnetic tape 11 can be conducted in an excellent condition by the magnetic head 9**. As a result, the supply and receipt of magnetic information in accordance with the recording/reproducing operation can be conducted without any fear of generation of an error.

Figure 5:
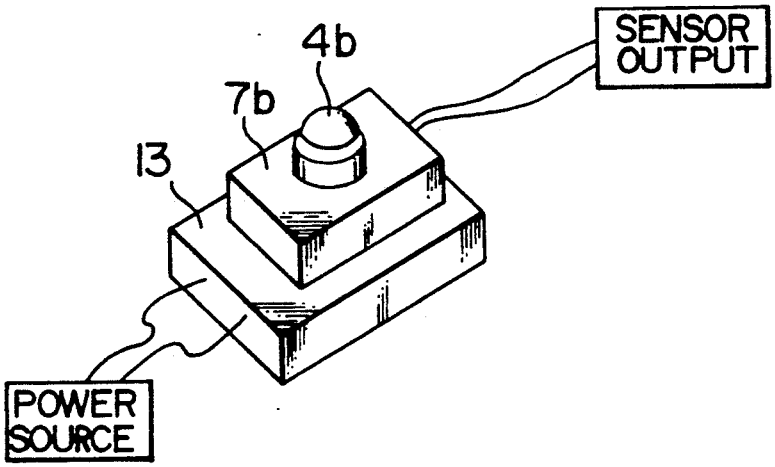
FIGS. 5, 6, and 7 are perspective views each of which illustrates other embodiments of the cleaning device of the present invention.

In FIG. 5, an optical sensor **4*b* having a light emitting/receiving function is supported by a support base 7*b* secured to a piezoelectric vibrator 13 with an adhesive. The piezoelectric vibrator 13 is disposed so as to be vibrated vertically, when viewed in the drawing, whenever a voltage is applied thereto. The optical sensor 4b comprises a sensor of a type capable of receiving light emitted therefrom and reflected by an object. That is, when an object is present, an output signal from the optical sensor 4b is excited. When another object to which light cannot be reflected is present between the object and the optical sensor 4b, the output signal from the optical sensor 4b** cannot be excited since light cannot be received.

With the construction of FIG. 5, when contamination such as dust or the like is adhered to the surface of the optical sensor 4b, the light quantity to be emitted or received is significantly reduced. Therefore, an output signal is transmitted from the optical sensor 4b as if an object is present between the optical sensor 4b and the object, although no object is actually present, thereby causing a misjudgment to be made. However, according to embodiment of FIG. 5, the contamination adhered to the surface of the optical sensor 4b can be swept away by vibrating the optical sensor 4b by the piezoelectric vibrator 13. As a result, the function provided for the optical sensor 4b can be retained.

Figure 6:
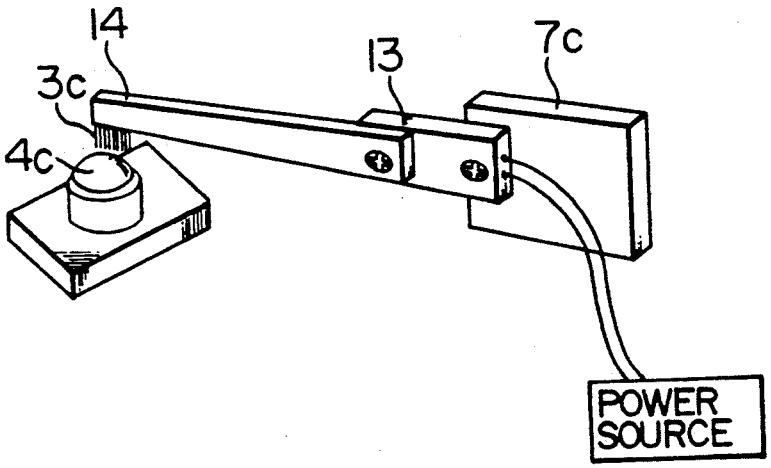

In FIG. 6, the piezoelectric vibrator 13 is secured to the support base 7 at an end thereof. A resonant arm 14 is arranged so as to be allowed to resonate at a resonant frequency of the piezoelectric vibrator 13 which is secured to the other end of the piezoelectric vibrator 13. A brush 3c is secured to the end portion of this resonant arm 14. The brush 3c is disposed so as to be brought into contact with the surface of the optical sensor 4c only when the resonant arm 14 is allowed to resonate, while the brush 3c and the resonant arm 14 are not present on the optical passage for the optical sensor 4c.

As a result of the above-described structure, when power is supplied to the piezoelectric vibrator 3c, this piezoelectric vibrator 13 is vibrated so that the resonant arm 14 is allowed to resonate and swing due to the vibration applied by the piezoelectric vibrator 13. As a result, the brush 3c is brought into contact with the surface of the optical sensor 4c so that the contamination such as dust adhered to the surface of the optical sensor 4c can be forcedly swept away. In addition, when power supply to the piezoelectric vibrator 13 is stopped, the resonant arm 14 and the brush 3c can be stopped at positions other than the positions on the optical passage for the optical sensor 4c.

Since the contamination of the optical sensor 4c can be thus prevented, the optical sensor 4c can perform the predetermined function thereof for detecting the signal passage timing or the predetermined function for detecting whether or not the object is present on the basis of the signal transmitted from the optical sensor 4c, this signal being generated due to the light emission and light receipt.

Figure 7:
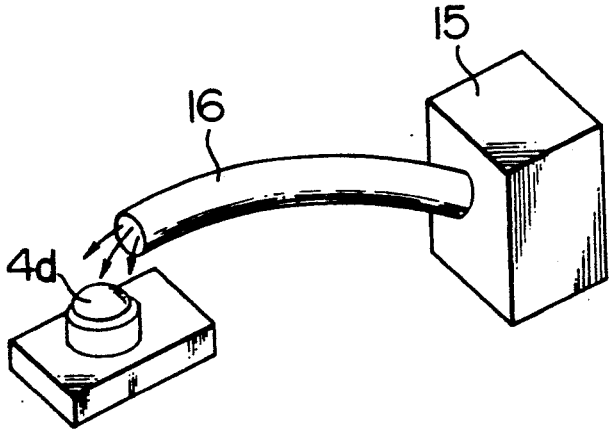

As shown in FIG. 7, to prevent the adhesion of the contamination such as dust, an air source 15 is provided for supplying compressed air. An air duct 16 is opened at a position adjacent to the surface of the optical sensor 4d so as to be capable of introducing air flow supplied from the air source 15.

Since the air flow is introduced into the optical sensor 4d, the contamination such as dust adhered to the surface of the optical sensor 4d can be swept away. Therefore, similarly to the above-described embodiments, the malfunction of the optical sensor 4d due to the contamination thereof can be prevented.

Figure 8:
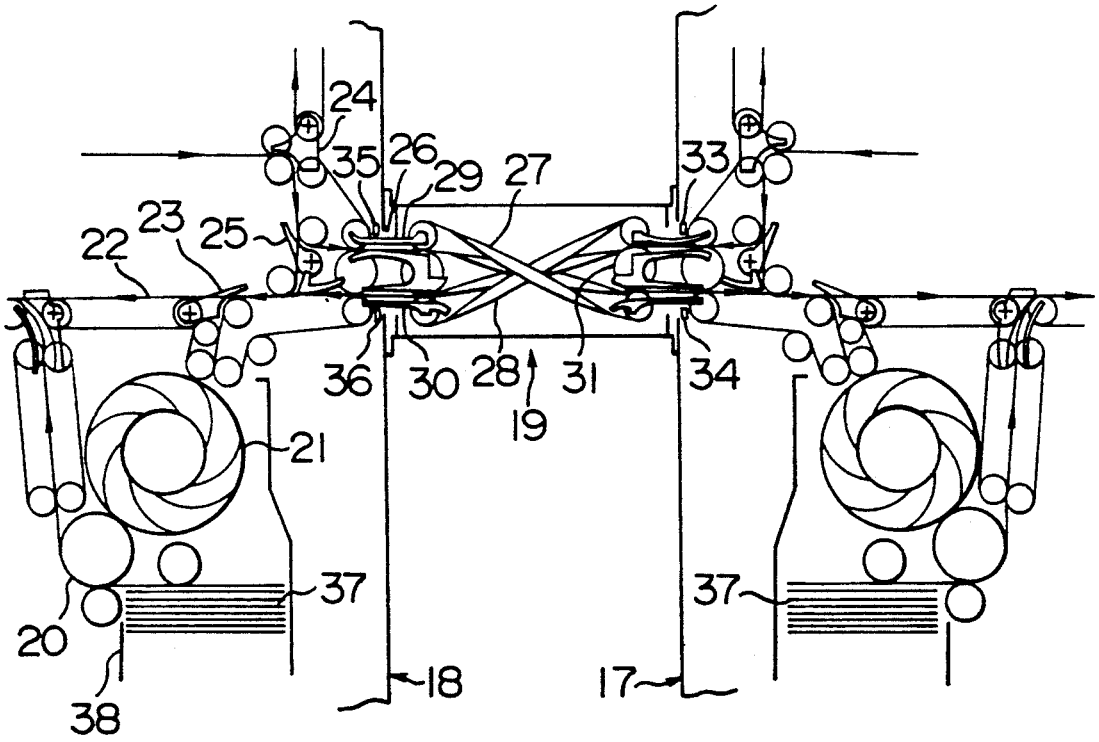
FIG. 8 is a structural view which illustrates an essential portion of an automatic paper-sheet depositing/dispensing apparatus according to the present invention.

In FIG. 8, two automatic bank note depositing/dispensing apparatuses 17, 18 are, on their rear sides thereof, connected to each other by a bank note depositing/dispensing means 19. Referring to this drawing, reference numeral 20 represents a device for separating bank notes, 21 represents a device for accumulating the bank notes, 22 represents a device formed by a belt or the like for conveying the bank note, 23 represents a gate portion disposed at the intersection of the conveying means 22. Reference numerals 24 and 25 represent switch gate portions, respectively, 26 represents an window, 27 and 28 represent conveying passages respectively, 29 and 30 represent guide portions respectively, and 31 and 32 represent roller, respectively.

In the above described automatic cash depositing/dispensing apparatus, when, for example, cash is dispensed, the bank notes 37 accommodated in an accommodating portion 38 are individually separated by the separation device 20 so as to be conveyed to the conveying means 22. On the other hand, when cash is deposited, the bank notes conveyed by the conveying means 22 are individually accumulated by the accumulating device 21 so as to be accommodated in the accommodating portion 38. During the above-described operations, each of the switch gate portions 23, 24, and 25 perform their predetermined switching actions so as to establish the designed conveying system. The guide portions 29 and 30 are each provided with the corresponding sensors 33, 34, 35, and 36 for detecting the number of the bank notes which have passed through the predetermined position. These sensors 33, 34, 35, and 36 are each provided with a cleaning device (omitted from illustration in FIG. 8, but as shown in FIGS. 1, 5, 6, and 7) for cleaning the surface of the components. These cleaning devices are arranged to be operated during the stoppage of the operation of the automatic cash depositing/dispensing apparatus so that the contamination of each surface of the sensors 33, 34, 35, and 36 is swept away. The structure may be arranged such that the cleaning devices provided for the sensors 33, 34, 35, and 36 are operated simultaneously by a sole operating means. Alternatively, they may be arranged to be operated individually. As a result, the sensors 33, 34, 35, and 36 can be correctly count the number of the bank notes which are being conveyed through the conveying system. Therefore, the malfunction or the system trouble of the depositing/dispensing apparatus can be significantly prevented.

Figure 9:
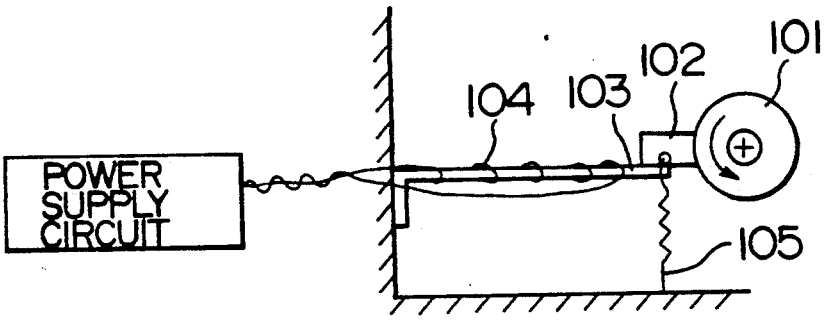
FIGS. 9 and 10 are views which illustrate another embodiment of the cleaning device according to the present invention.
Figure 10:
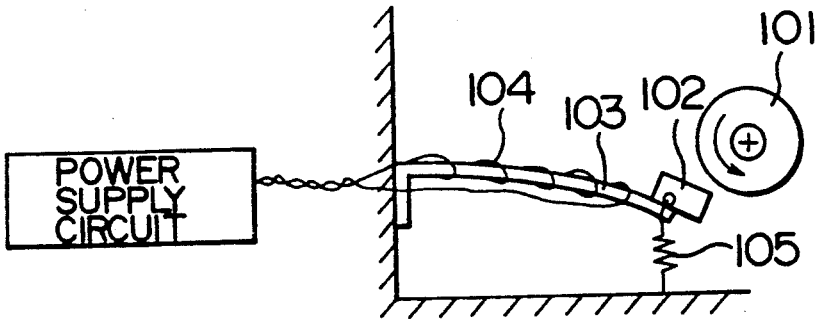

According to the embodiment of FIGS. 9 and 10, an example is described in which the structure arranged such that a shape is stored in the shape memory alloy is applied so as to sweep away contamination adhered to the surface of a rubber roller.

That is, a rubber roller 101 is so structured as to be capable of being rotated by a rotating means not shown. An whetstone 102 is secured to a drive element 103 made of the shape memory alloy. The drive element 103 has been previously subjected to a heat treatment such that the shape thereof can be, as shown in FIG. 9, transformed into a straight shape when the temperature exceeds a predetermined level. A heater 104 is wound around the drive element 103, this heater 104 being connected to a power input circuit.

A spring 105 is secured to an end of the whetstone 102, this spring 105 being arranged to have a characteristic with which it can be bent as shown in FIG. 10 when the temperature of the drive element 103 is lower than a predetermined value so that the spring 105 cannot come contact with the rubber roller 101 and another characteristic with which the transformation of the shape of the drive element 103 is, as shown in FIG. 9, enabled when the temperature of the drive element 103 exceeds the predetermined value.

If the surface of the rubber roller 101 is contaminated with ink, paper dust, or the like, or the friction coefficient between the rubber roller 101 and the corresponding component is lowered due to deterioration in the quality of the material for the rubber roller 101, power may be input to the power input circuit. As a result, the drive element 103 is, by the heater 104, heated up to a level which exceeds the transformation point of the drive element 103. Thus, the shape of the drive element 103 is, as shown in FIG. 9, transformed into the shape which has been previously stored, causing the whetstone 102 secured to the front end of the drive element 103 to be brought into contact with the rubber roller 101. When the rubber roller 101 is rotated with the contact established as described above maintained, the surface of the rubber roller 101 can be swept up and therefore the friction coefficient of the surface of the rubber roller 101 can be restored.

As described above, the function of the rubber roller 101 to convey articles by the surface traction thereof can be stably retained.

With the cleaning device according to the present invention, contamination adhered to the surface of the optical sensor or the like can be readily swept away. Therefore, the deterioration in the function of the detection device can be readily prevented.

According to the apparatus for automatically depositing/dispensing bank notes, since the cleaning devices are provided for the optical sensors, the deterioration in the function of the total system of the automatic depositing/dispensing apparatus can be readily prevented.

What is claimed is:

1. A cleaning device for cleaning contaminants from a surface of a component, said cleaning device comprising:

a cleaning member for cleaning said surface of said component;

an arm of a shape memory alloy for holding said cleaning member and storing therein a first shape for enabling said cleaning member to be positioned on said surface of said component and a second shape for enabling said cleaning member to be retracted from said surface of said component; and shape transforming means provided for said arm for enabling a transforming between said first shape and said second shape, and wherein said component comprises an optical sensor for an optical detection device.

2. An optical detection device including an optical sensor disposed on a support frame and a cleaning device disposed adjacent to said optical sensor, said optical detecting device comprising:

an arm of a shape memory alloy;

a cleaning member forming a part of the cleaning device and being disposed on a side of an edge of said arm so as to confront a light emitting/receiving surface of said optical sensor;

transforming means for transforming a shape of said arm; and a power supply circuit for supplying power to said transforming means.

3. A paper sheet depositing/dispensing apparatus comprising:

a conveying passage through which paper sheets are conveyed;

accumulating means for accommodating, in an accommodating portion, the paper sheets supplied from said conveying passage;

separation means for separating each of the paper sheets accommodated in said accommodating portion so as to convey the paper sheets to said conveying passage;

detection means for detecting the state in which the paper sheets are conveyed to said conveying passage; and a cleaning device for cleaning a detecting surface of said detection means comprising a cleaning member disposed so as to confront said detecting surface of said detection means, an arm a shape memory alloy for supporting said cleaning member, and transforming means for transforming a shape of said arm.

* * * * *